United States Patent [19]

Fieberg et al.

[11] Patent Number: 4,512,071

[45] Date of Patent: Apr. 23, 1985

[54] TOOL HOLDER

[75] Inventors: Russell F. Fieberg, Westminster; Donald E. Fieberg, Sunset Beach, both of Calif.

[73] Assignee: Russtech Engineering Company, Inc., Huntington Beach, Calif.

[21] Appl. No.: 432,242

[22] Filed: Jan. 24, 1983

[51] Int. Cl.[3] ..... B25G 3/02

[52] U.S. Cl. ..... 29/278

[58] Field of Search ..... 279/41 R; 81/177 G; 29/278, 280, 281.1

[56] References Cited

U.S. PATENT DOCUMENTS

| | | | |
|---|---|---|---|
| 651,267 | 6/1900 | Pickett | 29/278 |
| 881,298 | 3/1908 | Chappel | 279/41 |
| 1,472,349 | 10/1923 | Winchler | 29/278 |
| 3,752,202 | 8/1973 | Condon | 81/177 G |

FOREIGN PATENT DOCUMENTS

| | | | |
|---|---|---|---|
| 1960086 | 6/1971 | Fed. Rep. of Germany | 29/278 |

*Primary Examiner*—Robert C. Watson

*Attorney, Agent, or Firm*—Michael Bak-Boychuk

[57] ABSTRACT

A tool holder conformed to receive connector insertion and extraction tools for use when assembling or disassembling multipin connectors comprises a hollow handle provided with a lateral cavity conformed to receive the grasping portion of the tool. The handle is formed of a resilient material structure, like Nylon, and is provided at the end thereof with a circular end opening communicating with the lateral cavity. To facilitate the receipt of the tool in the tool holder one holder surface over the cavity is cut away providing a lateral gap in the end opening which is of a smaller dimension than the corresponding dimension of the inserted tool. Thus the tool is snapped into the cavity and opening and is retained therein by the resilient action of the remaining holder structure.

1 Claim, 4 Drawing Figures

TOOL HOLDER

BACKGROUND OF THE INVENTION

1. Field of the Invention

The present invention relates to tool holders and more particularly to tool holders conformed to retain insertion and extraction tools useful with electrical connectors.

2. Description of the Prior Art

The process of assembly of multi-pin electrical connectors frequently entails the insertion and extraction of electrical leads into the insulator body of the connector. Typically such insulator bodies are characterized by a resilient material structure provided with a plurality of bores or cavities each including a retaining clip by which each inserted lead is grasped. Accordingly, the installation or extraction of each lead requires deformation of the clip tabs typically achieved through the use of a tubular tool.

The insertion and extraction tools commonly used for this purpose are often shaped with small grasping areas and thus render the process manually difficult and cumbersome. In particular it is the occasional tight fit in the terminal bore that presents the major problem.

Accordingly, a tool holder which conveniently improves the manipulative convenience of the insertion and extraction tool is both desired and sought and it is such a tool holder that is described herein.

SUMMARY OF THE INVENTION

Briefly, the present inventive tool holder is generally conformed as an elongate cylindrical handle including a longitudinal bore extending through the middle thereof, one end of the handle being further provided with a lateral cavity communicating from the exterior into the central bore. The cavity is conformed to receive the larger grasping section of an insertion and extraction tool like that sold by ITT-Cannon under the Model No. CIET-20 or by Deutsch under Model No. M15570-22-1, each generally shaped as two conical segments extending from the grasping section, the segments including longitudinal slits for receiving the terminal lead. To secure the tool within the interior of the tool holder the lateral cavity ends at the free end of the handle in a circular opening cut off along a chord to derive a slot which is smaller than the opening diameter. Thus insertion of the tool calls for the deformation of the conical segments and the edges along the slot which by snapping action, insure retention.

Furthermore, the surface forming the chordwise cut in the end opening may be carried around the cavity to expose the enlarged grasping section. In this manner the lead passing through the tool may be pressed against the grasping section, as originally practiced, while the enlarged holder structure provides the necessary means for forceful manipulation.

DESCRIPTION OF THE PREFERRED EMBODIMENT

Figure 1:
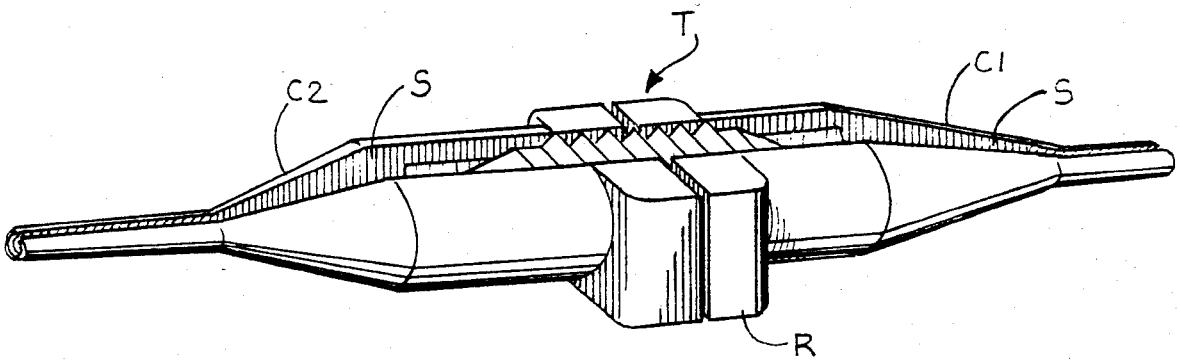
FIG. 1 is a perspective illustration of a prior art tool accommodated within the present inventive tool handle.

As shown in FIG. 1 the insertion and extraction tool T, typical of the prior art devices, comprises a rectangular grasping section R from which two conical segments C1 and C2 extend. Each conical segment C1 and C2 includes a longitudinal slot S conformed to receive the end portion of a lead which is to be either installed or withdrawn from a multi-pin connector. Since the connector is typically provided with tabbed metal inserts the installation end is somewhat different in shape from the extraction end and the user therefore must select the particular end to meet his operation. Accordingly, any tool holder retaining tool T must allow for convenient tool reversal while at the same time providing positive retention to permit a rather difficult manipulative sequence.

Figure 2:
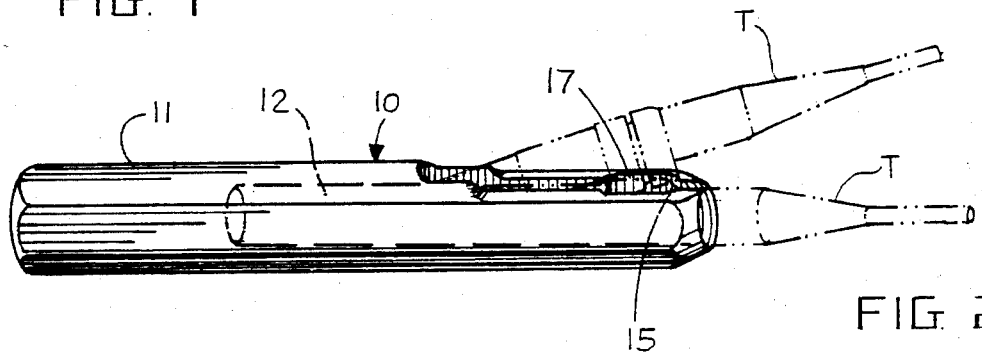
FIG. 2 is a side view, in section, of the inventive tool holder.
Figure 3:
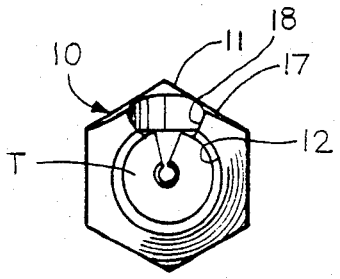
FIG. 3 is a sectional end view of the tool holder taken along line 3—3 of FIG. 2.
Figure 4:
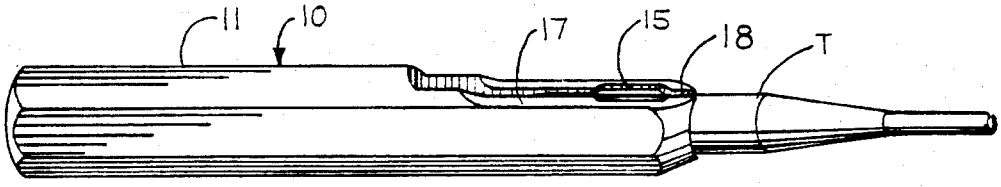
FIG. 4 is a perspective view of the inventive tool holder in combination with the insertion and extraction tool.

To achieve these objectives the inventive tool holder shown in FIGS. 2–4 and generally designated by the numeral 10, comprises an elongate handle 11 formed to include a longitudinal bore 12 extending therethrough. Bore 12 is dimensioned to receive the conical ends C1 and C2 of the tool T with the rectangular grasping section R being accommodated in a lateral cavity 15 extending through the side of the handle. The handle surface adjacent cavity 15 is shaved down along a cut 17 which at the same time forms a chordwise cut across the bore 12, thus forming at the end of the tool a chordwise slot 18 through which the tool may be inserted. In practice this slot 18 may be dimensioned to be smaller than the sectional dimension of the conical ends of the tool to provide a snap action when the tool is forced to align in the interior of the bore.

It is contemplated to form the tool holder of a plastic material structure, like the tool itself, which therefore provides the necessary resiliency to effect the passage of the tool through slot 18.

To further enhance the manipulative convenience of the handle, the exterior surfaces thereof may be shaped in irregular shapes and the cavity 15 may be aligned with slots 18 to expose the lead passing therethrough for compression against the grasping section R. Thus the holder 10 provides all of the benefits of an extension while at the same time exposing the necessary features of the tool.

Obviously many changes may be made to the foregoing description without departing from the spirit of the invention. It is therefore intended that the scope of the invention be determined solely on the claims appended hereto.

What is claimed is:

1. An elongate tool holder of a resilient material structure for retaining insertion and extraction tools useful in inserting and extracting electrical leads from a connector structure, said tool being characterized by two opposed frustoconical segments extending from a central grasping section provided with a rectangular enlargement all formed as a unitary structure of a resilient material, comprising:

an elongate handle provided with a circular central bore extending along the longitudinal axis thereof conformed to receive said frustoconical segments and a rectangular lateral cavity transversely extending into said bore for receiving said rectangular enlargement of said grasping section proximate one end of said handle, said handle further including a lateral cut-off surface over said lateral cavity in alignment over said grasping section enlargement, exposing a lateral gap in the surface of said central bore of a dimension smaller than the transverse dimension of either one of said frustoconical segments.

* * * * *